US009458853B2

(12) United States Patent
Staniforth et al.

(10) Patent No.: US 9,458,853 B2
(45) **Date of Patent: *Oct. 4, 2016**

(54) FAN ASSEMBLY

(75) Inventors: Mark Joseph Staniforth, Malmesbury (GB); Jude Paul Pullen, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 855 days.

This patent is subject to a terminal disclaimer.

(21) Appl. No.: 13/559,146

(22) Filed: Jul. 26, 2012

(65) Prior Publication Data

US 2013/0028766 A1 Jan. 31, 2013

(30) Foreign Application Priority Data

Jul. 27, 2011 (GB) ..... 1112909.5
Jul. 27, 2011 (GB) ..... 1112912.9

(51) Int. Cl.
*F04D 25/16* (2006.01)
*F04F 5/16* (2006.01)
*F04D 25/08* (2006.01)

(52) U.S. Cl.
CPC ..... *F04D 25/166* (2013.01); *F04D 25/08* (2013.01); *F04F 5/16* (2013.01)

(58) Field of Classification Search
CPC ..... F04F 5/16; F04F 5/463; F04F 5/14; F04F 5/20; F04F 5/46; F04F 5/466; F04F 5/467; F04D 25/166; F04D 25/08; B01F 5/00; B01F 5/0293; F24F 6/14; F24F 2006/008
USPC ..... 417/46, 47, 158, 165, 166, 313; 137/803, 565.26, 565.01, 597, 883, 137/88–93, 78.5
See application file for complete search history.

(56) References Cited

U.S. PATENT DOCUMENTS 284,962 A 9/1883 Huston
1,357,261 A 11/1920 Svoboda
(Continued)

FOREIGN PATENT DOCUMENTS

BE 560119 8/1957
CA 1055344 5/1979
(Continued)

OTHER PUBLICATIONS

Gammack et al., U.S. Office Action mailed Feb. 28, 2013, directed to U.S. Appl. No. 12/945,558; 16 pages.
(Continued)

*Primary Examiner* — Devon Kramer
*Assistant Examiner* — Joseph Herrmann
(74) *Attorney, Agent, or Firm* — Morrison & Foerster LLP

(57) ABSTRACT

A fan assembly includes a nozzle having a plurality of air inlets, a plurality of air outlets, a first air flow path and a second air flow path. Each air flow path extends from at least one of the air inlets to at least one of the air outlets. The nozzle defines a bore through which air from outside the fan assembly is drawn by air emitted from the nozzle. The fan assembly also includes a first user-operable system for generating a first air flow along the first air flow path, and a second user-operable system, different from the first user-operable system, for generating a second air flow along the second air flow path. Through user selection of one or both of these two systems, at least one of two different air flows can be emitted from the nozzle, each having a respective flow profile or other characteristic.

24 Claims, 8 Drawing Sheets

(56) References Cited

U.S. PATENT DOCUMENTS 1,767,060 A 6/1930 Ferguson
1,896,869 A 2/1933 Larsh
2,014,185 A 9/1935 Martin
2,035,733 A 3/1936 Wall
2,071,266 A 2/1937 Schmidt
D103,476 S 3/1937 Weber
2,115,883 A 5/1938 Sher
D115,344 S 6/1939 Chapman
2,210,458 A 8/1940 Keilholtz
2,258,961 A 10/1941 Saathoff
2,295,502 A 9/1942 Lamb
2,336,295 A 12/1943 Reimuller
2,363,839 A 11/1944 Demuth
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,711,682 A 6/1955 Drechsel
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,185,448 A * 5/1965 Fraser et al. ..... 366/162.4
3,270,655 A 9/1966 Guirl et al.
D206,973 S * 2/1967 De Lisio ..... D23/370
3,503,138 A 3/1970 Fuchs et al.
3,518,776 A 7/1970 Wolff et al.
3,724,092 A 4/1973 McCleerey
3,729,934 A 5/1973 Denning et al.
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A * 9/1977 Inglis ..... 417/197
4,061,188 A 12/1977 Beck
4,073,613 A 2/1978 Desty
4,090,814 A 5/1978 Teodorescu et al.
4,113,416 A 9/1978 Kataoka et al.
4,136,735 A 1/1979 Beck et al.
4,173,995 A 11/1979 Beck
4,180,130 A 12/1979 Beck et al.
4,184,417 A 1/1980 Chancellor
4,184,541 A 1/1980 Beck et al.
4,192,461 A 3/1980 Arborg
4,221,331 A * 9/1980 Goran, Jr. ..... 239/121
4,332,529 A 6/1982 Alperin
4,336,017 A 6/1982 Desty
4,342,204 A 8/1982 Melikian et al.
4,448,354 A 5/1984 Reznick et al.
4,568,243 A 2/1986 Schubert et al.
4,630,475 A 12/1986 Mizoguchi
4,634,050 A * 1/1987 Shippee ..... 239/14.2
4,643,351 A 2/1987 Fukamachi et al.
4,703,152 A 10/1987 Shih-Chin
4,716,946 A 1/1988 Grigoletto
4,718,870 A 1/1988 Watts
4,732,539 A 3/1988 Shin-Chin
4,734,017 A 3/1988 Levin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger
5,061,405 A 10/1991 Stanek et al.
D325,435 S 4/1992 Coup et al.
5,110,266 A 5/1992 Toyoshima et al.
5,168,722 A * 12/1992 Brock ..... 62/304
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,322,218 A * 6/1994 Melbourne ..... 239/2.2
5,338,495 A 8/1994 Steiner et al.
5,402,938 A 4/1995 Sweeney
5,407,324 A 4/1995 Starnes, Jr. et al.
5,425,902 A 6/1995 Miller et al.
5,435,489 A 7/1995 Jenkins et al.
5,483,616 A 1/1996 Chiu et al.
5,518,370 A 5/1996 Wang et al.
5,609,473 A 3/1997 Litvin
5,645,769 A 7/1997 Tamaru et al.
5,649,370 A 7/1997 Russo
5,671,321 A 9/1997 Bagnuolo
5,677,982 A 10/1997 Levine et al.
5,735,683 A 4/1998 Muschelknautz
5,762,034 A 6/1998 Foss
5,762,661 A 6/1998 Kleinberger et al.
5,783,117 A 7/1998 Byassee et al.
5,794,306 A 8/1998 Firdaus
D398,983 S 9/1998 Keller et al.
5,841,080 A 11/1998 Iida et al.
5,843,344 A 12/1998 Junket et al.
5,859,952 A 1/1999 Levine et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,073,881 A 6/2000 Chen
D429,808 S 8/2000 Krauss et al.
6,123,618 A 9/2000 Day
6,155,782 A 12/2000 Hsu
D435,899 S 1/2001 Melwani
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.
6,599,088 B2 7/2003 Stagg
6,604,694 B1 8/2003 Kordas et al.
D485,895 S 1/2004 Melwani
6,789,787 B2 9/2004 Stutts
6,791,056 B2 9/2004 VanOtteren et al.
6,830,433 B2 12/2004 Birdsell et al.
6,845,971 B2 1/2005 Bachert
7,059,826 B2 6/2006 Lasko
7,088,913 B1 8/2006 Verhoorn et al.
7,147,336 B1 12/2006 Chou
D539,414 S 3/2007 Russak et al.
7,192,258 B2 3/2007 Kuo et al.
7,198,473 B2 4/2007 Stickland et al.
7,412,781 B2 8/2008 Mattinger et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,660,110 B2 2/2010 Vinson et al.
7,664,377 B2 2/2010 Liao
D614,280 S 4/2010 Dyson et al.
7,731,050 B2 6/2010 Parks et al.
7,775,848 B1 8/2010 Auerbach
7,806,388 B2 10/2010 Junkel et al.
7,841,045 B2 11/2010 Shaanan et al.
7,931,449 B2 * 4/2011 Fitton et al. ..... 417/84
8,002,520 B2 8/2011 Dawson et al.

(56) References Cited

U.S. PATENT DOCUMENTS

| | | | | |
|---|---|---|---|---|
| 8,092,166 | B2 | 1/2012 | Nicolas et al. | |
| 8,113,490 | B2 | 2/2012 | Chen | |
| 8,152,495 | B2 | 4/2012 | Boggess, Jr. et al. | |
| 8,246,317 | B2 | 8/2012 | Gammack | |
| 8,308,445 | B2 | 11/2012 | Gammack et al. | |
| 8,348,629 | B2 | 1/2013 | Fitton et al. | |
| 8,356,804 | B2 | 1/2013 | Fitton et al. | |
| 8,454,322 | B2 | 6/2013 | Gammack et al. | |
| 8,529,226 | B2 | 9/2013 | Li | |
| 8,544,826 | B2 | 10/2013 | Ediger et al. | |
| 8,721,307 | B2 | 5/2014 | Li | |
| 9,127,855 | B2 | 9/2015 | Staniforth et al. | |
| 9,291,361 | B2 * | 3/2016 | Staniforth | F04D 25/08 |
| 2002/0104972 | A1 | 8/2002 | Guzorek | |
| 2002/0106547 | A1 | 8/2002 | Sugawara et al. | |
| 2003/0059307 | A1 | 3/2003 | Moreno et al. | |
| 2003/0164367 | A1 | 9/2003 | Bucher et al. | |
| 2003/0171093 | A1 | 9/2003 | Gumucio Del Pozo | |
| 2003/0190183 | A1 | 10/2003 | Hsing | |
| 2004/0022631 | A1 | 2/2004 | Birdsell et al. | |
| 2004/0049842 | A1 | 3/2004 | Prehodka | |
| 2004/0106370 | A1 | 6/2004 | Honda et al. | |
| 2004/0149881 | A1 | 8/2004 | Allen | |
| 2005/0031448 | A1 | 2/2005 | Lasko et al. | |
| 2005/0053465 | A1 | 3/2005 | Roach et al. | |
| 2005/0069407 | A1 | 3/2005 | Winkler et al. | |
| 2005/0128698 | A1 | 6/2005 | Huang | |
| 2005/0163670 | A1 | 7/2005 | Alleyne et al. | |
| 2005/0173997 | A1 | 8/2005 | Schmid et al. | |
| 2005/0281672 | A1 | 12/2005 | Parker et al. | |
| 2006/0172682 | A1 | 8/2006 | Orr et al. | |
| 2006/0199515 | A1 | 9/2006 | Lasko et al. | |
| 2006/0263073 | A1 | 11/2006 | Clarke et al. | |
| 2006/0279927 | A1 | 12/2006 | Strohm | |
| 2007/0035189 | A1 | 2/2007 | Matsumoto | |
| 2007/0041857 | A1 | 2/2007 | Fleig | |
| 2007/0065280 | A1 | 3/2007 | Fok | |
| 2007/0166160 | A1 | 7/2007 | Russak et al. | |
| 2007/0176502 | A1 | 8/2007 | Kasai et al. | |
| 2007/0224044 | A1 | 9/2007 | Hong et al. | |
| 2007/0237500 | A1 | 10/2007 | Wang | |
| 2007/0269323 | A1 | 11/2007 | Zhou et al. | |
| 2008/0020698 | A1 | 1/2008 | Spaggiari | |
| 2008/0124060 | A1 | 5/2008 | Gao | |
| 2008/0152482 | A1 | 6/2008 | Patel | |
| 2008/0166224 | A1 | 7/2008 | Giffin | |
| 2008/0286130 | A1 | 11/2008 | Purvines | |
| 2008/0314250 | A1 | 12/2008 | Cowie et al. | |
| 2009/0026850 | A1 | 1/2009 | Fu | |
| 2009/0032130 | A1 * | 2/2009 | Dumas et al. | 137/829 |
| 2009/0039805 | A1 | 2/2009 | Tang | |
| 2009/0060710 | A1 | 3/2009 | Gammack et al. | |
| 2009/0060711 | A1 | 3/2009 | Gammack et al. | |
| 2009/0078120 | A1 | 3/2009 | Kummer et al. | |
| 2009/0120925 | A1 | 5/2009 | Lasko | |
| 2009/0191054 | A1 | 7/2009 | Winkler | |
| 2009/0214341 | A1 | 8/2009 | Craig | |
| 2010/0133707 | A1 | 6/2010 | Huang | |
| 2010/0150699 | A1 | 6/2010 | Nicolas et al. | |
| 2010/0162011 | A1 | 6/2010 | Min | |
| 2010/0171465 | A1 | 7/2010 | Seal et al. | |
| 2010/0225012 | A1 * | 9/2010 | Fitton et al. | 261/116 |
| 2010/0226749 | A1 | 9/2010 | Gammack et al. | |
| 2010/0226750 | A1 | 9/2010 | Gammack | |
| 2010/0226751 | A1 | 9/2010 | Gammack et al. | |
| 2010/0226752 | A1 | 9/2010 | Gammack et al. | |
| 2010/0226753 | A1 | 9/2010 | Dyson et al. | |
| 2010/0226754 | A1 | 9/2010 | Hutton et al. | |
| 2010/0226758 | A1 | 9/2010 | Cookson et al. | |
| 2010/0226763 | A1 | 9/2010 | Gammack et al. | |
| 2010/0226764 | A1 | 9/2010 | Gammack et al. | |
| 2010/0226769 | A1 | 9/2010 | Helps | |
| 2010/0226771 | A1 | 9/2010 | Crawford et al. | |
| 2010/0226787 | A1 | 9/2010 | Gammack et al. | |
| 2010/0226797 | A1 | 9/2010 | Fitton et al. | |
| 2010/0226801 | A1 | 9/2010 | Gammack | |
| 2010/0254800 | A1 | 10/2010 | Fitton et al. | |
| 2011/0058935 | A1 | 3/2011 | Gammack et al. | |
| 2011/0110805 | A1 | 5/2011 | Gammack et al. | |
| 2011/0164959 | A1 | 7/2011 | Fitton et al. | |
| 2011/0223014 | A1 | 9/2011 | Crawford et al. | |
| 2011/0223015 | A1 | 9/2011 | Gammack et al. | |
| 2011/0259980 | A1 | 10/2011 | Akisada et al. | |
| 2012/0031509 | A1 | 2/2012 | Wallace et al. | |
| 2012/0033952 | A1 | 2/2012 | Wallace et al. | |
| 2012/0034108 | A1 | 2/2012 | Wallace et al. | |
| 2012/0039705 | A1 | 2/2012 | Gammack | |
| 2012/0045315 | A1 | 2/2012 | Gammack | |
| 2012/0045316 | A1 | 2/2012 | Gammack | |
| 2012/0057959 | A1 | 3/2012 | Hodgson et al. | |
| 2012/0082561 | A1 | 4/2012 | Gammack et al. | |
| 2012/0093629 | A1 | 4/2012 | Fitton et al. | |
| 2012/0093630 | A1 | 4/2012 | Fitton et al. | |
| 2012/0114513 | A1 | 5/2012 | Simmonds et al. | |
| 2012/0230658 | A1 | 9/2012 | Fitton et al. | |
| 2012/0308375 | A1 | 12/2012 | Gammack | |
| 2013/0026664 | A1 | 1/2013 | Staniforth et al. | |
| 2013/0028763 | A1 | 1/2013 | Staniforth et al. | |
| 2013/0129490 | A1 | 5/2013 | Dos Reis et al. | |
| 2013/0161842 | A1 | 6/2013 | Fitton et al. | |
| 2013/0199372 | A1 | 8/2013 | Nock et al. | |
| 2013/0234346 | A1 | 9/2013 | Staniforth et al. | |
| 2013/0234347 | A1 | 9/2013 | Staniforth et al. | |
| 2013/0249122 | A1 | 9/2013 | Staniforth et al. | |
| 2013/0249124 | A1 | 9/2013 | Staniforth et al. | |
| 2013/0249126 | A1 | 9/2013 | Staniforth et al. | |
| 2013/0272858 | A1 | 10/2013 | Stickney et al. | |
| 2013/0280051 | A1 | 10/2013 | Nicolas et al. | |
| 2013/0280061 | A1 | 10/2013 | Stickney | |
| 2013/0280096 | A1 | 10/2013 | Gammack et al. | |
| 2013/0323100 | A1 | 12/2013 | Poulton et al. | |
| 2014/0077398 | A1 | 3/2014 | Staniforth et al. | |
| 2014/0079566 | A1 | 3/2014 | Gammack et al. | |
| 2014/0084492 | A1 | 3/2014 | Staniforth et al. | |
| 2014/0210114 | A1 | 7/2014 | Staniforth et al. | |
| 2014/0210115 | A1 | 7/2014 | Staniforth et al. | |
| 2014/0255173 | A1 | 9/2014 | Poulton et al. | |
| 2014/0255217 | A1 | 9/2014 | Li | |
| 2015/0338113 | A1 | 11/2015 | Staniforth et al. | |
| 2016/0153673 | A1 | 6/2016 | Staniforth et al. | |

FOREIGN PATENT DOCUMENTS

| | | |
|---|---|---|
| CA | 2155482 | 9/1996 |
| CH | 346643 | 5/1960 |
| CN | 2085866 | 10/1991 |
| CN | 2111392 | 7/1992 |
| CN | 2549372 | 5/2003 |
| CN | 1437300 | 8/2003 |
| CN | 2650005 | 10/2004 |
| CN | 2713643 | 7/2005 |
| CN | 1680727 | 10/2005 |
| CN | 2833197 | 11/2006 |
| CN | 201011346 | 1/2008 |
| CN | 201147215 | 11/2008 |
| CN | 201180678 | 1/2009 |
| CN | 201221477 | 4/2009 |
| CN | 101424279 | 5/2009 |
| CN | 101451754 A | 6/2009 |
| CN | 201281416 | 7/2009 |
| CN | 201349269 | 11/2009 |
| CN | 101684828 | 3/2010 |
| CN | 201486901 | 5/2010 |
| CN | 101749288 | 6/2010 |
| CN | 201502549 | 6/2010 |
| CN | 201507461 | 6/2010 |
| CN | 101825096 | 9/2010 |
| CN | 101825101 | 9/2010 |
| CN | 101825102 | 9/2010 |
| CN | 101825103 A | 9/2010 |
| CN | 101825104 | 9/2010 |
| CN | 201568337 | 9/2010 |
| CN | 101858355 | 10/2010 |
| CN | 101936310 | 1/2011 |

(56) References Cited

FOREIGN PATENT DOCUMENTS

| | | | |
|---|---|---|---|
| CN | 201696365 | U | 1/2011 |
| CN | 201696366 | | 1/2011 |
| CN | 201739199 | U | 2/2011 |
| CN | 101984299 | | 3/2011 |
| CN | 101985948 | | 3/2011 |
| CN | 201763705 | | 3/2011 |
| CN | 201763706 | | 3/2011 |
| CN | 201770513 | | 3/2011 |
| CN | 201771875 | | 3/2011 |
| CN | 201779080 | | 3/2011 |
| CN | 201786777 | | 4/2011 |
| CN | 201786778 | | 4/2011 |
| CN | 201802648 | | 4/2011 |
| CN | 102095236 | | 6/2011 |
| CN | 201858204 | | 6/2011 |
| CN | 201874898 | | 6/2011 |
| CN | 201874901 | U | 6/2011 |
| CN | 201917047 | | 8/2011 |
| CN | 102251973 | A | 11/2011 |
| CN | 102287357 | | 12/2011 |
| CN | 102367813 | | 3/2012 |
| CN | 202267207 | | 6/2012 |
| CN | 202431623 | | 9/2012 |
| DE | 1 291 090 | | 3/1969 |
| DE | 24 51 557 | | 5/1976 |
| DE | 27 48 724 | | 5/1978 |
| DE | 3644567 | | 7/1988 |
| DE | 195 10 397 | | 9/1996 |
| DE | 197 12 228 | | 10/1998 |
| DE | 100 00 400 | | 3/2001 |
| DE | 10041805 | | 6/2002 |
| DE | 10 2009 007 037 | | 8/2010 |
| EP | 0 044 494 | | 1/1982 |
| EP | 0186581 | | 7/1986 |
| EP | 0 459 812 | | 12/1991 |
| EP | 0 784 947 | | 7/1997 |
| EP | 1 094 224 | | 4/2001 |
| EP | 1 138 954 | | 10/2001 |
| EP | 1357296 | B1 | 10/2003 |
| EP | 1 779 745 | | 5/2007 |
| EP | 1 939 456 | | 7/2008 |
| EP | 1 980 432 | | 10/2008 |
| EP | 2 000 675 | | 12/2008 |
| EP | 2191142 | | 6/2010 |
| EP | 2 414 738 | | 2/2012 |
| EP | 2 578 889 | | 4/2013 |
| FR | 1033034 | | 7/1953 |
| FR | 1119439 | | 6/1956 |
| FR | 1.387.334 | | 1/1965 |
| FR | 2 375 471 | | 7/1978 |
| FR | 2 534 983 | | 4/1984 |
| FR | 2 640 857 | | 6/1990 |
| FR | 2 658 593 | | 8/1991 |
| FR | 2794195 | | 12/2000 |
| FR | 2 874 409 | | 2/2006 |
| FR | 2 906 980 | | 4/2008 |
| FR | 2928706 | | 9/2009 |
| GB | 22235 | | 6/1914 |
| GB | 383498 | | 11/1932 |
| GB | 593828 | | 10/1947 |
| GB | 601222 | | 4/1948 |
| GB | 633273 | | 12/1949 |
| GB | 641622 | | 8/1950 |
| GB | 661747 | | 11/1951 |
| GB | 863 124 | | 3/1961 |
| GB | 1067956 | | 5/1967 |
| GB | 1 262 131 | | 2/1972 |
| GB | 1 265 341 | | 3/1972 |
| GB | 1 278 606 | | 6/1972 |
| GB | 1 304 560 | | 1/1973 |
| GB | 1 403 188 | | 8/1975 |
| GB | 1 434 226 | | 5/1976 |
| GB | 1 501 473 | | 2/1978 |
| GB | 2 094 400 | | 9/1982 |
| GB | 2 107 787 | | 5/1983 |
| GB | 2 111 125 | | 6/1983 |
| GB | 2 178 256 | | 2/1987 |
| GB | 2 185 531 | | 7/1987 |
| GB | 2 185 533 | | 7/1987 |
| GB | 2 218 196 | | 11/1989 |
| GB | 2 236 804 | | 4/1991 |
| GB | 2 240 268 | | 7/1991 |
| GB | 2 242 935 | | 10/1991 |
| GB | 2 285 504 | | 7/1995 |
| GB | 2 289 087 | | 11/1995 |
| GB | 2383277 | | 6/2003 |
| GB | 2 428 569 | | 2/2007 |
| GB | 2 452 593 | | 3/2009 |
| GB | 2452490 | | 3/2009 |
| GB | 2463698 | | 3/2010 |
| GB | 2464736 | | 4/2010 |
| GB | 2466058 | | 6/2010 |
| GB | 2468312 | | 9/2010 |
| GB | 2468313 | | 9/2010 |
| GB | 2468315 | | 9/2010 |
| GB | 2468317 | A | 9/2010 |
| GB | 2468319 | | 9/2010 |
| GB | 2468320 | | 9/2010 |
| GB | 2468323 | | 9/2010 |
| GB | 2468328 | | 9/2010 |
| GB | 2468329 | | 9/2010 |
| GB | 2468331 | | 9/2010 |
| GB | 2468369 | | 9/2010 |
| GB | 2468498 | | 9/2010 |
| GB | 2473037 | | 3/2011 |
| GB | 2479760 | | 10/2011 |
| GB | 2482547 | | 2/2012 |
| GB | 2484671 | | 4/2012 |
| GB | 2484695 | A | 4/2012 |
| GB | 2484761 | | 4/2012 |
| GB | 2493231 | A | 1/2013 |
| GB | 2493505 | A | 2/2013 |
| GB | 2493507 | A | 2/2013 |
| GB | 2500011 | | 9/2013 |
| JP | 31-13055 | | 8/1956 |
| JP | 35-4369 | | 3/1960 |
| JP | 39-7297 | | 3/1964 |
| JP | 46-7230 | | 12/1971 |
| JP | 47-21718 | | 10/1972 |
| JP | 49-43764 | | 4/1974 |
| JP | 49-150403 | | 12/1974 |
| JP | 51-7258 | | 1/1976 |
| JP | 52-121045 | | 9/1977 |
| JP | 53-60100 | | 5/1978 |
| JP | 56-167897 | | 12/1981 |
| JP | 57-71000 | | 5/1982 |
| JP | 57-157097 | | 9/1982 |
| JP | 61-31830 | | 2/1986 |
| JP | 61-116093 | | 6/1986 |
| JP | 61-280787 | | 12/1986 |
| JP | 62-98099 | | 5/1987 |
| JP | 62-223494 | | 10/1987 |
| JP | 63-36794 | | 3/1988 |
| JP | 63-179198 | | 7/1988 |
| JP | 63-198933 | | 12/1988 |
| JP | 63-306340 | | 12/1988 |
| JP | 64-21300 | | 2/1989 |
| JP | 64-58955 | | 3/1989 |
| JP | 64-83884 | | 3/1989 |
| JP | 1-138399 | | 5/1989 |
| JP | 1-224598 | | 9/1989 |
| JP | 2-146294 | | 6/1990 |
| JP | 2-218890 | | 8/1990 |
| JP | 2-248690 | | 10/1990 |
| JP | 3-52515 | | 5/1991 |
| JP | 3-267598 | | 11/1991 |
| JP | 3-286775 | | 12/1991 |
| JP | 4-43895 | | 2/1992 |
| JP | 4-366330 | | 12/1992 |
| JP | 5-99386 | | 4/1993 |
| JP | 5-157093 | | 6/1993 |
| JP | 5-164089 | | 6/1993 |
| JP | 5-263786 | | 10/1993 |
| JP | 6-74190 | | 3/1994 |

(56) References Cited

FOREIGN PATENT DOCUMENTS

| | | |
|---|---|---|
| JP | 6-86898 | 3/1994 |
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 8-21400 | 1/1996 |
| JP | 8-72525 | 3/1996 |
| JP | 8-313019 | 11/1996 |
| JP | 9-86154 | 3/1997 |
| JP | 9-100800 | 4/1997 |
| JP | 9-178083 | 7/1997 |
| JP | 9-287600 | 11/1997 |
| JP | 11-502586 | 3/1999 |
| JP | 11-227866 | 8/1999 |
| JP | 2000-55419 | 2/2000 |
| JP | 2000-116179 | 4/2000 |
| JP | 2000-201723 | 7/2000 |
| JP | 2001-17358 | 1/2001 |
| JP | 2002-21797 | 1/2002 |
| JP | 2002-138829 | 5/2002 |
| JP | 2002-213388 | 7/2002 |
| JP | 2003-4265 | 1/2003 |
| JP | 2003-329273 | 11/2003 |
| JP | 2004-8275 | 1/2004 |
| JP | 2004-208935 | 7/2004 |
| JP | 2004-216221 | 8/2004 |
| JP | 2005-201507 | 7/2005 |
| JP | 2005-307985 | 11/2005 |
| JP | 2006-89096 | 4/2006 |
| JP | 2006-189221 | 7/2006 |
| JP | 3127331 | 11/2006 |
| JP | 3129024 | 2/2007 |
| JP | 2007-138763 | 6/2007 |
| JP | 2007-138789 | 6/2007 |
| JP | 2008-37247 | 2/2008 |
| JP | 2008-39316 | 2/2008 |
| JP | 2008-100204 | 5/2008 |
| JP | 3144127 | 8/2008 |
| JP | 3146538 | 10/2008 |
| JP | 2008-294243 | 12/2008 |
| JP | 2009-41835 | 2/2009 |
| JP | 2009-44568 | 2/2009 |
| JP | 2009-62986 | 3/2009 |
| JP | 2009-275925 | 11/2009 |
| JP | 2010-46411 | 3/2010 |
| JP | 2010-131259 | 6/2010 |
| JP | 2010-203760 | 9/2010 |
| JP | 2010-203764 | 9/2010 |
| JP | 2012-31806 | 2/2012 |
| KR | 1999-002660 | 1/1999 |
| KR | 10-2005-0102317 | 10/2005 |
| KR | 2007-0007997 | 1/2007 |
| KR | 20-0448319 | 3/2010 |
| KR | 10-2010-0055611 | 5/2010 |
| KR | 10-0985378 | 9/2010 |
| TW | 517825 | 1/2003 |
| TW | 589932 | 6/2004 |
| TW | M331585 | 5/2008 |
| TW | M394383 | 12/2010 |
| TW | M399207 | 3/2011 |
| TW | M407299 | 7/2011 |
| WO | WO-90/13478 | 11/1990 |
| WO | WO-95/06822 | 3/1995 |
| WO | WO-02/073096 | 9/2002 |
| WO | WO-03/058795 | 7/2003 |
| WO | WO-03/069931 | 8/2003 |
| WO | WO-2005/050026 | 6/2005 |
| WO | WO 2005/057091 | 6/2005 |
| WO | WO-2006/008021 | 1/2006 |
| WO | WO-2006/012526 | 2/2006 |
| WO | WO-2007/024955 | 3/2007 |
| WO | WO-2007/048205 | 5/2007 |
| WO | WO-2008/014641 | 2/2008 |
| WO | WO-2008/024569 | 2/2008 |
| WO | WO-2008/139491 | 11/2008 |
| WO | WO-2009/030879 | 3/2009 |
| WO | WO-2009/030881 | 3/2009 |
| WO | WO-2010/100449 | 9/2010 |
| WO | WO-2010/100451 | 9/2010 |
| WO | WO-2010/100452 | 9/2010 |
| WO | WO-2010/100453 | 9/2010 |
| WO | WO-2010/100462 | 9/2010 |
| WO | WO-2011/050041 A1 | 4/2011 |
| WO | WO-2011/147318 | 12/2011 |
| WO | WO-2012/006882 A1 | 1/2012 |
| WO | WO-2012/033517 A1 | 3/2012 |
| WO | WO-2012/052737 | 4/2012 |
| WO | WO-2013/014419 A2 | 1/2013 |
| WO | WO-2013/132218 | 9/2013 |

OTHER PUBLICATIONS

Gammack et al., U.S. Office Action mailed Feb. 14, 2013, directed to U.S. Appl. No. 12/716,515; 21 pages.
Gammack et al., U.S. Office Action mailed Mar. 14, 2013, directed to U.S. Appl. No. 12/716,740; 15 pages.
Fitton et al., U.S. Office Action mailed Dec. 31, 2013, directed to U.S. Appl. No. 13/718,693; 8 pages.
Staniforth et al., U.S. Office Action mailed Nov. 14, 2014, directed to U.S. Appl. No. 13/559,145; 9 pages.
Gammack, P. et al., U.S. Office Action mailed Feb. 10, 2014, directed to U.S. Appl. No. 12/716,515; 21 pages.
Li et al., U.S. Office Action mailed Oct. 25, 2013, directed to U.S. Appl. No. 13/686,480; 17 pages.
Gammack et al., U.S. Office Action mailed Apr. 24, 2014, directed to U.S. Appl. No. 12/716,740; 16 pages.
Fitton et al., U.S. Office Action mailed Jun. 13, 2014, directed to U.S. Appl. No. 13/274,998; 11 pages.
Fitton et al., U.S. Office Action mailed Jun. 13, 2014, directed to U.S. Appl. No. 13/275,034; 10 pages.
Gammack, P. et al. U.S. Office Action mailed Oct. 18, 2012, directed to U.S. Appl. No. 12/917,247; 11 pages.
Helps, D. F. et al., U.S. Office Action mailed Feb. 15, 2013, directed to U.S. Appl. No. 12/716,694; 12 pages.
Gammack et al., Office Action mailed Jun. 12, 2013, directed towards U.S. Appl. No. 12/945,558; 20 pages.
Gammack et al., Office Action mailed May 29, 2013, directed towards U.S. Appl. No. 13/588,666; 11 pages.
Wallace et al., Office Action mailed Jun. 7, 2013, directed towards U.S. Appl. No. 13/192,223; 30 pages.
International Search Report and Written Opinion dated May 24, 2013, directed towards International Application No. PCT/GB2012/051490; 8 pages.
Gammack, P. et al., Office Action mailed Aug. 19, 2013, directed to U.S. Appl. No. 12/716,515; 20 pages.
Staniforth et al., U.S. Office Action mailed Sep. 18, 2014, directed to U.S. Appl. No. 13/559,142; 18 pages.
Gammack et al., U.S. Office Action mailed Sep. 3, 2014, directed to U.S. Appl. No. 13/861,891; 7 pages.
Gammack et al., U.S. Office Action mailed Sep. 6, 2013, directed to U.S. Appl. No. 12/716,740; 15 pages.
Gammack et al., Office Action mailed Sep. 27, 2013, directed to U.S. Appl. No. 13/588,666; 10 pages.
Wallace et al., Office Action mailed Oct. 23, 2013, directed to U.S. Appl. No. 13/192,223; 18 pages.
Staniforth et al., U.S. Office Action mailed Aug. 28, 2015, directed to U.S. Appl. No. 14/817,122; 6 pages.
Search Report dated Oct. 13, 2011, directed to GB Application No. 1112912.9; 1 page.
Search Report dated Oct. 13, 2011, directed to GB Application No. 1112909.5; 1 page.
Gammack, P. et al., U.S. Office Action mailed Dec. 9, 2010, directed to U.S. Appl. No. 12/203,698; 10 pages.
Gammack, P. et al., U.S. Office Action mailed Jun. 21,2011, directed to U.S. Appl. No. 12/203,698; 11 pages.
Gammack et al., Office Action mailed Sep. 17, 2012, directed to U.S. Appl. No. 13/114,707; 12 pages (20219.01).

(56) References Cited

OTHER PUBLICATIONS

Gammack, P. et al., U.S. Office Action mailed Dec. 10, 2010, directed to U.S. Appl. No. 12/230,613; 12 pages.
Gammack, P. et al., U.S. Office Action mailed May 13, 2011, directed to U.S. Appl.No. 12/230,613; 13 pages.
Gammack, P. et al., U.S. Office Action mailed Sep. 7, 2011, directed to U.S. Appl. No. 12/230,613; 15 pages.
Gammack, P. et al., U.S. Office Action mailed Jun. 8, 2012, directed to U.S. Appl. No. 12/230,613; 15 pages.
Gammack et al., U.S. Office Action mailed Aug. 20, 2012, directed to U.S. Appl. No. 12/945,558; 15 pages. (20220.01).
Fitton et al., U.S. Office Action mailed Nov. 30, 2010 directed to U.S. Appl. No. 12/560,232; 9 pages.
Nicolas, F. et al., U.S. Office Action mailed Mar. 7, 2011, directed to U.S. Appl. No. 12/622,844; 10 pages.
Nicolas, F. et al., U.S. Office Action mailed Sep. 8, 2011, directed to U.S. Appl. No. 12/622,844; 11 pages.
Fitton, et al., U.S. Office Action mailed Mar. 8, 2011, directed to U.S. Appl. No. 12/716,780; 12 pages.
Fitton, et al., U.S. Office Action mailed Sep. 6, 2011, directed to U.S. Appl. No. 12/716,780; 16 pages.
Gammack, P. et al., U.S. Office Action mailed Dec. 9, 2010, directed to U.S. Appl. No. 12/716,781; 17 pages.
Gammack, P. et al., U.S. Final Office Action mailed Jun. 24, 2011, directed to U.S. Appl. No. 12/716,781; 19 pages.
Gammack, P. et al., U.S. Office Action mailed Apr. 12, 2011, directed to U.S. Appl. No. 12/716,749; 8 pages.
Gammack, P. et al., U.S. Office Action mailed Sep. 1, 2011, directed to U.S. Appl. No. 12/716,749; 9 pages.
Gammack, P. et al., U.S. Office Action mailed Jun. 25, 2012, directed to U.S. Appl. No. 12/716,749; 11 pages.
Fitton et al., U.S. Office Action mailed Mar. 30, 2012, directed to U.S. Appl. No. 12/716,707; 7 pages.
Gammack, P. et al., U.S. Office Action mailed May 24, 2011, directed to U.S. Appl. No. 12/716,613; 9 pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.
Staniforth et al., U.S. Office Action mailed May 5, 2015, directed to U.S. Appl. No. 13/559,142; 18 pages.

* cited by examiner

C - C

FAN ASSEMBLY

REFERENCE TO RELATED APPLICATIONS

This application claims the priority of United Kingdom Application No. 1112912.9, filed Jul. 27, 2011, and United Kingdom Application No. 1112909.5, filed Jul. 27, 2011, the entire contents of which are incorporated herein by reference.

FIELD OF THE INVENTION

The present invention relates to a fan assembly.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generally located within a cage which allows an air flow to pass through the housing while preventing users from coming into contact with the rotating blades during use of the fan.

U.S. Pat. No. 2,488,467 describes a fan which does not use caged blades to project air from the fan assembly. Instead, the fan assembly comprises a base which houses a motor-driven impeller for drawing an air flow into the base, and a series of concentric, annular nozzles connected to the base and each comprising an annular outlet located at the front of the nozzle for emitting the air flow from the fan. Each nozzle extends about a bore axis to define a bore about which the nozzle extends.

Each nozzle is in the shape of an airfoil. An airfoil may be considered to have a leading edge located at the rear of the nozzle, a trailing edge located at the front of the nozzle, and a chord line extending between the leading and trailing edges. In U.S. Pat. No. 2,488,467 the chord line of each nozzle is parallel to the bore axis of the nozzles. The air outlet is located on the chord line, and is arranged to emit the air flow in a direction extending away from the nozzle and along the chord line.

Another fan assembly which does not use caged blades to project air from the fan assembly is described in WO 2009/030879. This fan assembly comprises a cylindrical base which also houses a motor-driven impeller for drawing a primary air flow into the base, and a single annular nozzle connected to the base and comprising an annular mouth through which the primary air flow is emitted from the fan. The nozzle defines an opening through which air in the local environment of the fan assembly is drawn by the primary air flow emitted from the mouth, amplifying the primary air flow. The nozzle includes a Coanda surface over which the mouth is arranged to direct the primary air flow. The Coanda surface extends symmetrically about the central axis of the opening so that the air flow generated by the fan assembly is in the form of an annular jet having a cylindrical or frusto-conical profile.

SUMMARY OF THE INVENTION

In a first aspect, the present invention provides a fan assembly comprising a nozzle having a plurality of air inlets, a plurality of air outlets, a first air flow path and, preferably separate from the first air flow path, a second air flow path, each air flow path extending from at least one of the air inlets to at least one of the air outlets, the nozzle defining a bore through which air from outside the fan assembly is drawn by air emitted from the nozzle, a first user-operable system for generating a first air flow along the first air flow path, and a second user-operable system, different from the first user-operable system, for generating a second air flow along the second air flow path.

The present invention can thus allow a user to vary the air flow generated by the fan assembly by actuating selectively one or both of the user-operable systems, which each generate an air flow within a respective air flow path of the nozzle. For example, the first user-operable system may be configured to generate a relatively high speed air flow through the first air flow path, with the air outlet(s) of the first air flow path being arranged to maximize the entrainment of air surrounding the nozzle within the first air flow emitted from the nozzle. This can allow the fan assembly to produce an air flow which is capable of cooling rapidly a user positioned in front of the fan assembly. The noise generated by the fan assembly when producing this air flow may be relatively high, and so the second user-operable system may be configured to generate a quieter, slower air flow to generate a slower, cooling breeze over a user.

Alternatively, or additionally, the second user-operable system may be arranged to change a sensorial property of the second air flow before it is emitted from the nozzle. This property of the second air flow can include one or more of the temperature, humidity, composition and electrical charge of the second air flow. For example, where the second user-operable system is arranged to heat the second air flow, through user operation of the second user-operable system alone the fan assembly can generate a low speed, high temperature air flow which can warm a user located in close proximity of the fan assembly. When both the first and second user-operable systems are operated simultaneously so that the first and second air flows are emitted from the fan assembly, the first air flow can disperse the high temperature second air flow rapidly within a room or other environment in which the fan assembly is located, elevating the temperature of the room as a whole rather than that of the environment local to the user. When only the first user-operable system is operated by the user, the fan assembly can deliver a high speed, cooling air flow to a user.

Part of the second user-operable system may be located within the nozzle of the fan assembly. For example, a heating arrangement for heating the second air flow may be located within the second air flow path through the nozzle. To minimize the size of the nozzle, each user-operable system is preferably located upstream from its respective air flow path. The fan assembly preferably comprises a first air passageway for conveying the first air flow to the first air flow path and a second air passageway for conveying the second air flow to the second air flow path, and so each user-operable system may be at least partially located within a respective one of the air passageways.

The fan assembly preferably comprises an air flow inlet for admitting at least the first air flow into the fan assembly. The air flow inlet may comprise a single aperture, but it is preferred that the air flow inlet comprises a plurality of apertures. These apertures may be provided by a mesh, a grille or other molded component forming part of the external surface of the fan assembly.

The first air passageway preferably extends from the air flow inlet to the first air flow path of the nozzle. The second air passageway may be arranged to receive air directly from the air flow inlet. Alternatively, the second air passageway may be arranged to receive air from the first air passageway. In this case, the junction between the air passageways may be located downstream or upstream from the first user-operable system. An advantage of locating the junction upstream from the first user-operable system is that the flow rate of the second air flow may be controlled to a value which is appropriate for the chosen means for changing the humidity, temperature or other parameter of the second air flow.

The nozzle is preferably mounted on a body housing the first and second user-operable systems. In this case, the air passageways are preferably located in the body, and so the user-operable systems are each preferably located within the body. The air passageways may be arranged within the body in any desired configuration depending on, inter alia, the location of the air flow inlet and the nature of the chosen means for changing the humidity or temperature of the second air flow. To reduce the size of the body, the first air passageway may be located adjacent the second air passageway. Each air passageway may extend vertically through the body, with the second air passageway extending vertically in front of the first air passageway.

Each user-operable system preferably comprises an impeller and a motor for driving the impeller. In this case, the first user-operable system may comprise a first impeller and a first motor for driving the first impeller to generating an air flow through the air flow inlet, and the second user-operable system may comprise a second impeller and a second motor for driving the second impeller to generate the second air flow by drawing part of the generated air flow away from the first impeller. This allows the second impeller to be driven to generate the second air flow as and when it is required by the user.

A common controller may be provided for controlling each motor. For example, the controller may be configured to allow the first and second motors to be actuated separately, or to allow the second motor to be actuated if the first motor is currently actuated or if the second motor is actuated simultaneously with the first motor. The controller may be arranged to deactivate the motors separately, or to deactivate the second motor automatically if the first motor is deactivated by a user. For instance, when the second user-operable system is arranged to increase the humidity of the second air flow, the controller may be arranged to drive the second motor only when the first motor is being driven.

Preferably, the first air flow is emitted at a first air flow rate and the second air flow is emitted at a second air flow rate which is lower than the first air flow rate. The first air flow rate may be a variable air flow rate, whereas the second air flow rate may be a constant air flow rate. To generate these different air flows, the first impeller may be different from the second impeller. For example, the first impeller may be a mixed flow impeller or an axial impeller, and the second impeller may be a radial impeller. Alternatively, or additionally, the first impeller may be larger than the second impeller. The nature of the first and second motors may be selected depending on the chosen impeller and the maximum flow rate of the relative air flow.

The air outlet(s) of the first air flow path are preferably located behind the air outlet(s) of the second air flow path so that the second air flow can be conveyed away from the nozzle within the first air flow. The first air flow path is preferably defined by a rear section of the nozzle, and the second air flow path is preferably defined by a front section of the nozzle. Each section of the nozzle is preferably annular. Each section of the nozzle preferably comprises a respective interior passage for conveying air from the air inlet(s) to the air outlet(s) of that section. The two sections of the nozzle may be provided by respective components of the nozzle, which may be connected together during assembly. Alternatively, the interior passages of the nozzle may be separated by a dividing wall or other partitioning member located between common inner and outer walls of the nozzle. The interior passage of the rear section is preferably isolated from the interior passage of the front section, but a relatively small amount of air may be bled from the rear section to the front section to urge the second air flow through the air outlet(s) of the front section of the nozzle. As the flow rate of the first air flow is preferably greater than the flow rate of the second air flow, the volume of the first air flow path of the nozzle is preferably greater than the volume of the front section of the nozzle.

The first air flow path of the nozzle may comprise a single continuous air outlet, which preferably extends about the bore of the nozzle, and is preferably centered on the axis of the bore. Alternatively, the first air flow path of the nozzle may comprise a plurality of air outlets which are arranged about the bore of the nozzle. For example, the air outlets of the first air flow path may be located on opposite sides of the bore. The air outlet(s) of the first air flow path are preferably arranged to emit air through at least a front part of the bore. This front part of the bore may be defined by at least the front section of the nozzle and may also be defined by part of the rear section of the nozzle. The air outlet(s) of the first air flow path may be arranged to emit air over a surface defining this front part of the bore to maximize the volume of air which is drawn through the bore by the air emitted from the first air flow path of the nozzle.

The air outlet(s) of the second air flow path of the nozzle may be arranged to emit the second air flow over this surface of the nozzle. Alternatively, the air outlet(s) of the front section may be located in a front end of the nozzle, and arranged to emit air away from the surfaces of the nozzle. The second air flow path may comprise a single continuous air outlet, which may extend about the front end of the nozzle. Alternatively, the second air flow path may comprise a plurality of air outlets, which may be arranged about the front end of the nozzle. For example, the air outlets of the second air flow path may be located on opposite sides of the front end of the nozzle.

Each of the plurality of air outlets of the second air flow path may comprise one or more apertures, for example, a slot, a plurality of linearly aligned slots, or a plurality of apertures.

In a preferred embodiment, the second user-operable system comprises a humidifying system which is configured to increase the humidity of the second air flow before it is emitted from the nozzle. To provide the fan assembly with a compact appearance and with a reduced component number, at least part of the humidifying system may be located beneath the nozzle. At least part of the humidifying system may also be located beneath the first impeller and the first motor. For example, a transducer for atomizing water may be located beneath the nozzle. This transducer may be controlled by a controller that controls the second motor.

The body may comprise a removable water tank for supplying water to the humidifying system.

In a second aspect, the present invention provides a fan assembly comprising a nozzle having a first section having at least one first air inlet, at least one first air outlet, and a first interior passage for conveying air from said at least one first air inlet to said at least one first air outlet, and a second section having at least one second air inlet, at least one second air outlet, and a second interior passage, which is preferably isolated from the first interior passage, for conveying air from said at least one second air inlet to said at least one second air outlet, the sections of the nozzle defining a bore through which air from outside the fan assembly is drawn by air emitted from the nozzle, a first user-operable system for generating a first air flow through the first interior passage, and a second user-operable system for generating a second air flow through the second interior passage, the first user-operable system being selectively operable separately from the second user-operable system.

Features described above in connection with the first aspect of the invention are equally applicable to the second aspect of the invention, and vice versa.

BRIEF DESCRIPTION OF THE INVENTION

An embodiment of the present invention will now be described, by way of example only, with reference to the accompanying drawings, in which.

DETAILED DESCRIPTION OF THE INVENTION

Figure 1:
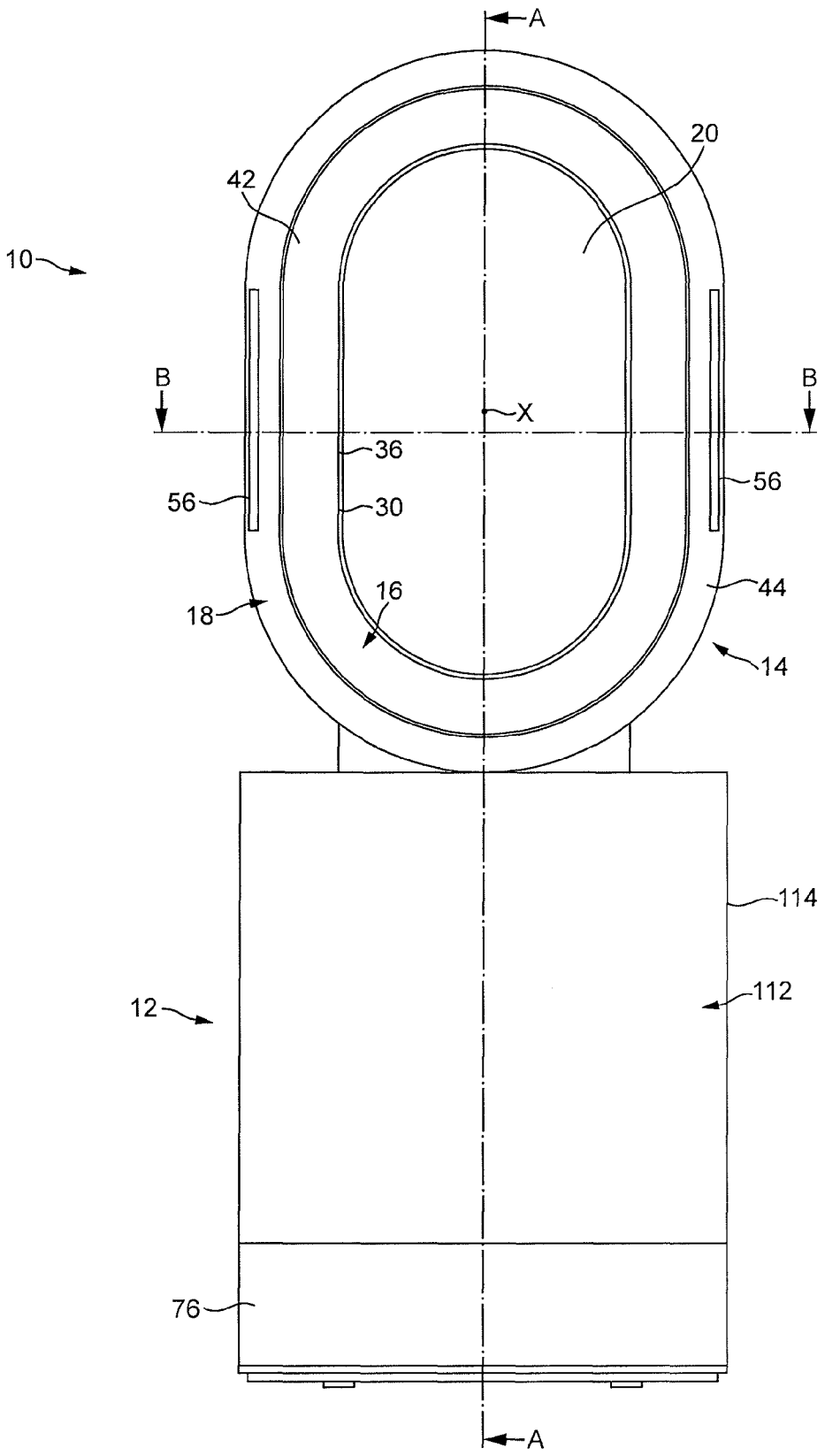
FIG. 1 is a front view of a fan assembly.
Figure 2:
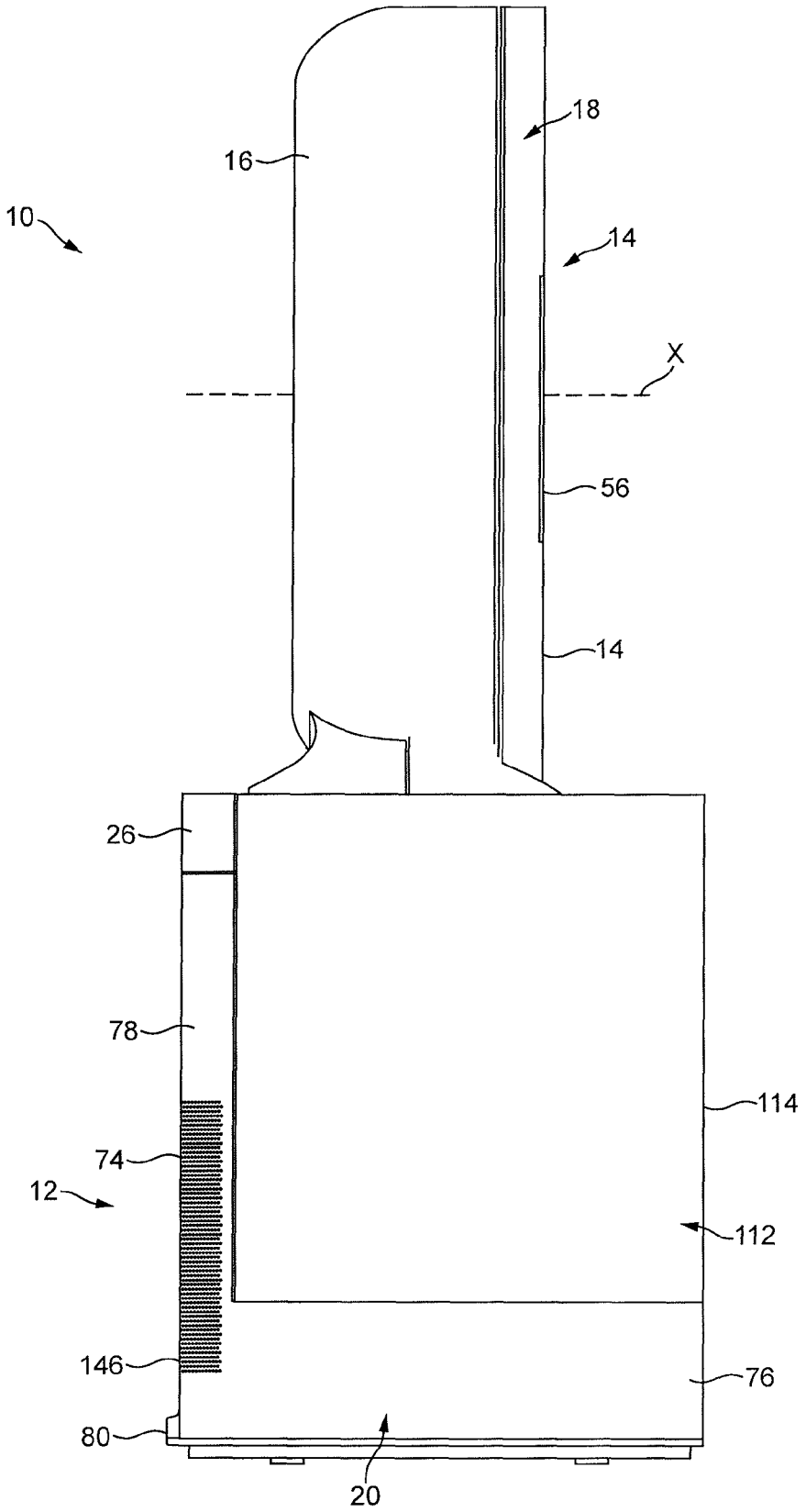
FIG. 2 is a side view of the fan assembly.
Figure 3:
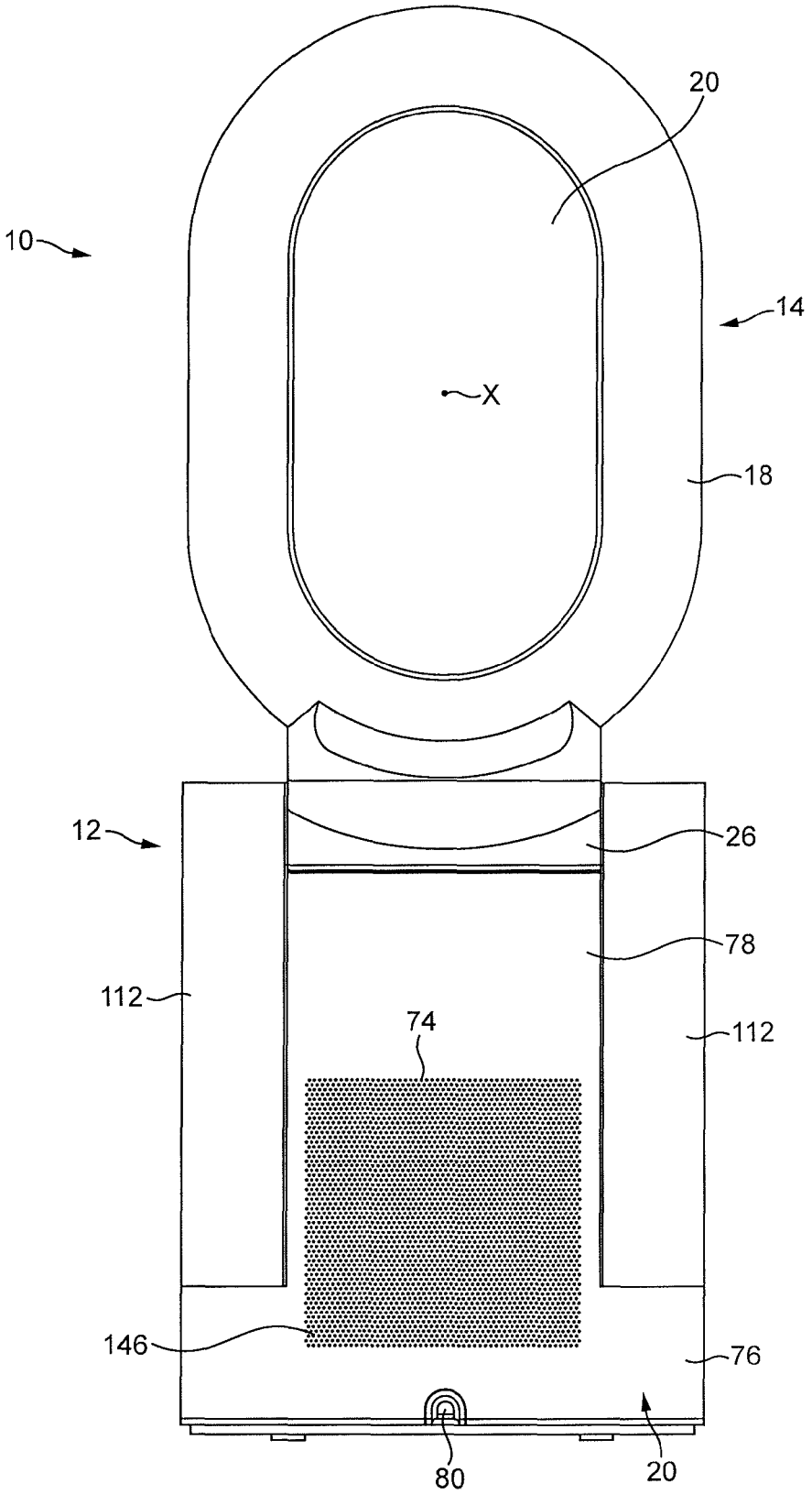
FIG. 3 is a rear view of the fan assembly.

FIGS. 1 to 3 are external views of a fan assembly 10. In overview, the fan assembly 10 comprises a body 12 comprising a plurality of air flow inlets through which air enters the fan assembly 10, and a nozzle 14 in the form of an annular casing mounted on the body 12, and which comprises a plurality of air outlets for emitting air from the fan assembly 10.

The nozzle 14 is arranged to emit, either simultaneously or separately, two different air flows. The nozzle 14 comprises a rear section 16 and a front section 18 connected to the rear section 16. Each section 16, 18 is annular in shape, and together the sections 16, 18 define a bore 20 of the nozzle 14. The bore 20 extends centrally through the nozzle 14, so that the center of each section 16, 18 is located on the axis X of the bore 20.

In this example, each section 16, 18 has a "racetrack" shape, in that each section 16, 18 comprises two, generally straight sections located on opposite sides of the bore 20, a curved upper section joining the upper ends of the straight sections and a curved lower section joining the lower ends of the straight sections. However, the sections 16, 18 may have any desired shape; for example the sections 16, 18 may be circular or oval. In this embodiment, the height of the nozzle 14 is greater than the width of the nozzle, but the nozzle 14 may be configured so that the width of the nozzle 14 is greater than the height of the nozzle.

Each section 16, 18 of the nozzle 14 defines a flow path along which a respective one of the air flows passes. In this embodiment, the rear section 16 of the nozzle 14 defines a first air flow path along which a first air flow passes through the nozzle 14, and the front section 18 of the nozzle 14 defines a second air flow path along which a second air flow passes through the nozzle 14.

Figure 4:
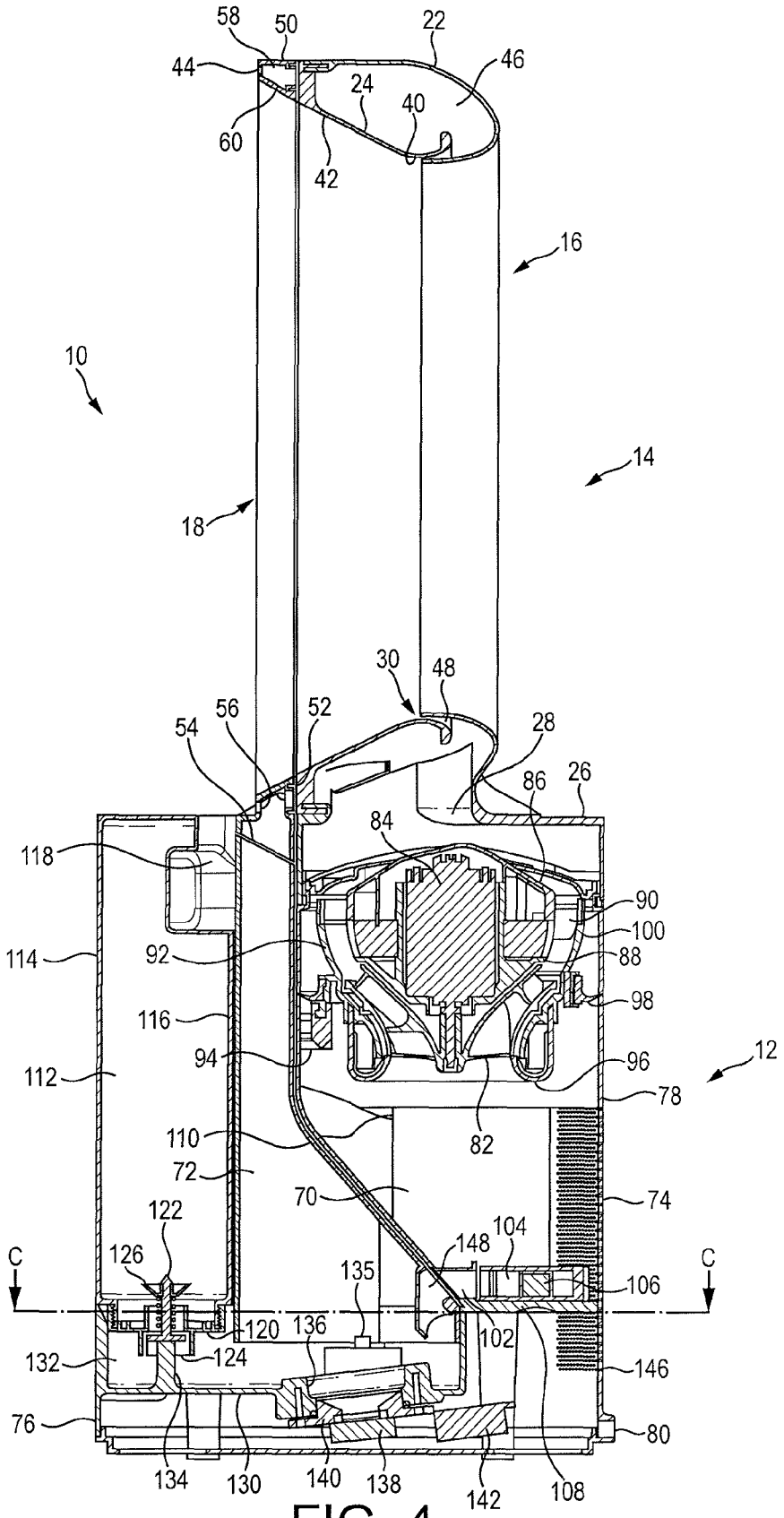
FIG. 4 is a side sectional view taken along line A-A in FIG. 1.

With reference also to FIG. 4, the rear section 16 of the nozzle 14 comprises an annular outer casing section 22 connected to and extending about an annular inner casing section 24. Each casing section 22, 24 extends about the bore axis X. Each casing section may be formed from a plurality of connected parts, but in this embodiment each casing section 22, 24 is formed from a respective, single molded part.

Figure 5:
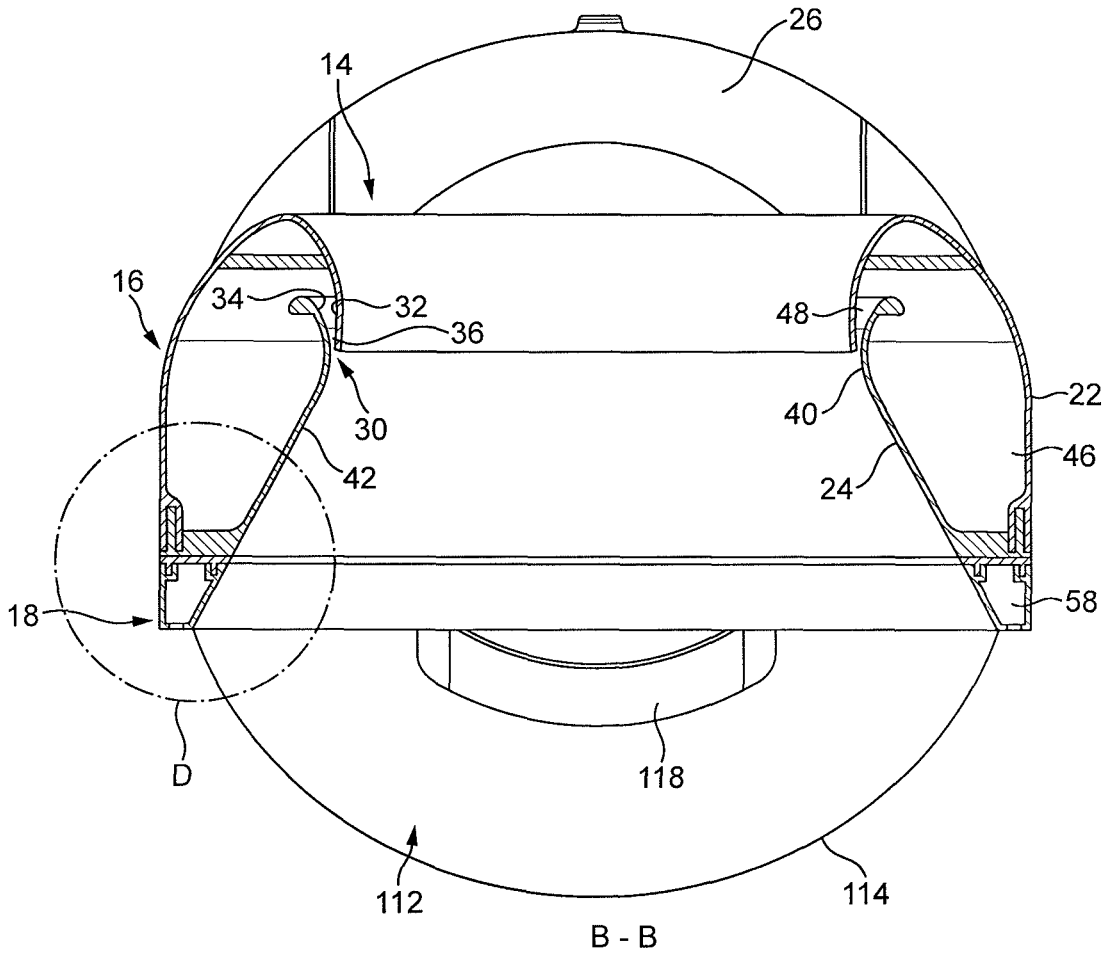
FIG. 5 is a top sectional view taken along line B-B in FIG. 1.
Figure 6:
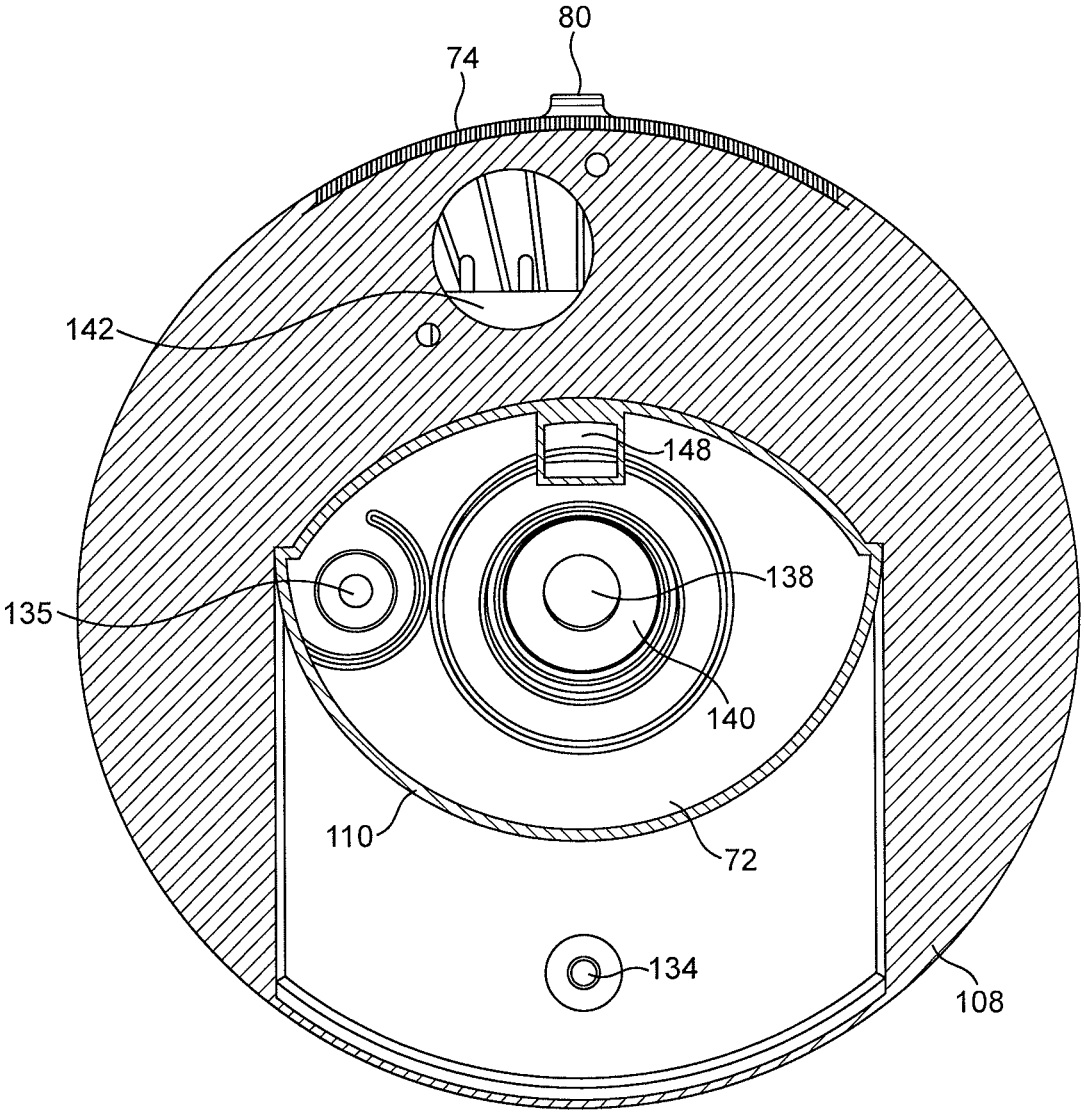
FIG. 6 is a top sectional view taken along line C-C in FIG. 4, with the water tank removed.
Figure 7:
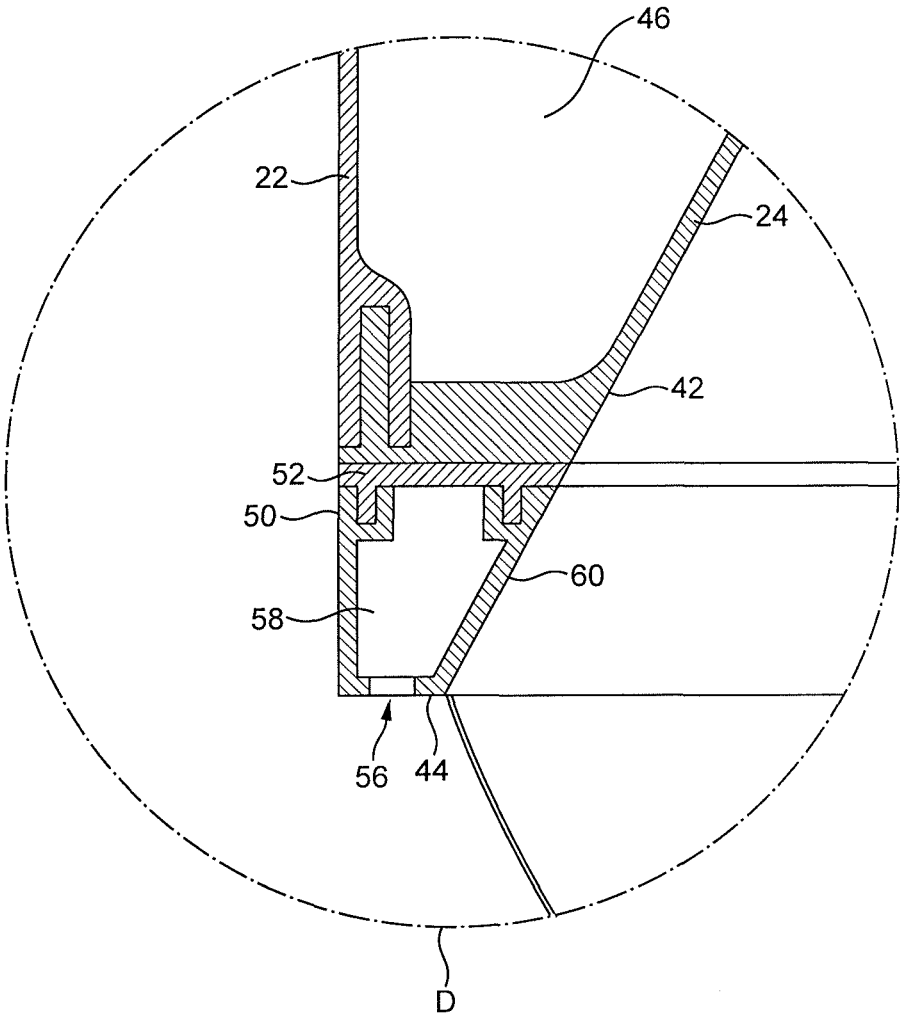
FIG. 7 is a close-up of area D indicated in FIG. 5.

With reference also to FIGS. 5 and 7, during assembly the front end of the outer casing section 22 is connected to the front end of the inner casing section 24. An annular protrusion formed on the front end of the inner casing section 24 is inserted into an annular slot located at the front end of the outer casing section 22. The casing sections 22, 24 may be connected together using an adhesive introduced to the slot.

The outer casing section 22 comprises a base 26 which is connected to an open upper end of the body 12, and which defines a first air inlet 28 of the nozzle 14. The outer casing section 22 and the inner casing section 24 together define a first air outlet 30 of the nozzle 14. The first air outlet 30 is defined by overlapping, or facing, portions of the internal surface 32 of the outer casing section 22 and the external surface 34 of the inner casing section 24. The first air outlet 30 is in the form of an annular slot, which has a relatively constant width in the range from 0.5 to 5 mm about the bore axis X. In this example the first air outlet has a width of around 1 mm. Spacers 36 may be spaced about the first air outlet 30 for urging apart the overlapping portions of the outer casing section 22 and the inner casing section 24 to control the width of the first air outlet 30. These spacers may be integral with either of the casing sections 22, 24.

The first air outlet 30 is arranged to emit air through a front part of the bore 20 of the nozzle 14. The first air outlet 30 is shaped to direct air over an external surface of the nozzle 14. In this embodiment, the external surface of the inner casing section 24 comprises a Coanda surface 40 over which the first air outlet 30 is arranged to direct the first air flow. The Coanda surface 40 is annular, and thus is continuous about the central axis X. The external surface of the inner casing section 24 also includes a diffuser portion 42 which tapers away from the axis X in a direction extending from the first air outlet 30 to the front end 44 of the nozzle 14.

The casing sections 22, 24 together define an annular first interior passage 46 for conveying the first air flow from the first air inlet 28 to the first air outlet 30. The first interior passage 46 is defined by the internal surface of the outer casing section 22 and the internal surface of the inner casing section 24. A tapering, annular mouth 48 of the rear section 16 of the nozzle 14 guides the first air flow to the first air outlet 30. The first air flow path through the nozzle 14 may therefore be considered to be formed from the first air inlet 28, the first interior passage 46, the mouth 48 and the first air outlet 30.

The front section 18 of the nozzle 14 comprises an annular front casing section 50 connected to an annular rear casing section 52. Each casing section 50, 52 extends about the bore axis X. Similar to the casing sections 22, 24, each casing section 50, 52 may be formed from a plurality of connected parts, but in this embodiment each casing section 50, 52 is formed from a respective, single molded part. With reference again to FIGS. 5 and 7, during assembly the front end of the rear casing section 52 is connected to the rear end of the front casing section 50. Annular protrusions formed on the front end of the rear casing section 52 are inserted into slots located at the rear end of the front casing section 50, and into which an adhesive is introduced. The rear casing section 52 is connected to the front end of the inner casing section 24 of the rear section 18 of the nozzle 14, for example also using an adhesive. If so desired, the rear casing section 52 may be omitted, with the front casing section 50 being connected directly to the front end of the inner casing section 24 of the rear section 18 of the nozzle 14.

The lower end of the front casing section 50 defines a second air inlet 54 of the nozzle 14. The front casing section 50 also define a plurality of second air outlets 56 of the nozzle 14. The second air outlets 56 are formed in the front end 44 of the nozzle 14, each on a respective side of the bore 20, for example by molding or machining. The second air outlets 56 are thus configured to emit the second air flow away from the nozzle 14. In this example, each second air outlet 56 is in the form of a slot having a relatively constant width in the range from 0.5 to 5 mm. In this example each second air outlet 56 has a width of around 1 mm. Alternatively, each second air outlet 56 may be in the form of a row of circular apertures or slots formed in the front end 44 of the nozzle 14.

The casing sections 50, 52 together define an annular second interior passage 58 for conveying the first air flow from the second air inlet 54 to the second air outlets 56. The second interior passage 58 is defined by the internal surfaces of the casing sections 50, 52. The second air flow path through the nozzle 14 may therefore be considered to be formed by the second air inlet 54, the interior passage 58 and the second air outlets 56.

The body 12 is generally cylindrical in shape. With reference to FIGS. 1 to 4, the body 12 comprises a first air passageway 70 for conveying the first air flow to the first air flow path through the nozzle 14, and a second air passageway 72 for conveying the second air flow to the second air flow path through the nozzle 14. Air is admitted into the body 12 by an air flow inlet 74. In this embodiment, the air flow inlet 74 comprises a plurality of apertures formed in a casing section of the body 12. Alternatively, the air flow inlet 74 may comprise one or more grilles or meshes mounted within windows formed in the casing section. The casing section of the body 12 comprises a generally cylindrical base 76 which has the same diameter as the body 12, and a tubular rear section 78 which is integral with the base 76 and has a curved outer surface which provides part of the outer surface of the rear of the body 12. The air flow inlet 74 is formed in the curved outer surface of the rear section 78 of the casing section. The base 26 of the rear section 16 of the nozzle 14 is mounted on an open upper end of the rear section 78 of the casing section.

The base 76 of the casing section may comprise a user interface of the fan assembly 10. The user interface is illustrated schematically in FIG. 8, and described in more detail below. A mains power cable (not shown) for supplying electrical power to the fan assembly 10 extends through an aperture 80 formed in the base 76.

The first air passageway 70 passes through the rear section 78 of the casing section, and houses a first user-operable system for generating a first air flow through the first air passageway 70. This first user-operable system comprises a first impeller 82, which in this embodiment is in the form of a mixed flow impeller. The first impeller 82 is connected to a rotary shaft extending outwardly from a first motor 84 for driving the first impeller 82. In this embodiment, the first motor 84 is a DC brushless motor having a speed which is variable by a control circuit in response to a speed selection by a user. The maximum speed of the first motor 84 is preferably in the range from 5,000 to 10,000 rpm. The first motor 84 is housed within a motor bucket comprising an upper portion 86 connected to a lower portion 88. The upper portion 88 of the motor bucket comprises a diffuser 90 in the form of a stationary disc having spiral blades. An annular foam silencing member may also be located within the motor bucket. The diffuser 90 is located directly beneath the first air inlet 28 of the nozzle 14.

The motor bucket is located within, and mounted on, a generally frusto-conical impeller housing 92. The impeller housing 92 is, in turn, mounted on a plurality of angularly spaced supports 94, in this example three supports, located within and connected to the rear section 78 of the body 12. An annular inlet member 96 is connected to the bottom of the impeller housing 92 for guiding the air flow into the impeller housing 92.

A flexible sealing member 98 is mounted on the impeller housing 92. The flexible sealing member prevents air from passing around the outer surface of the impeller housing to the inlet member 96. The sealing member 98 preferably comprises an annular lip seal, preferably formed from rubber. The sealing member 98 further comprises a guide portion for guiding an electrical cable 100 to the first motor 84.

The second air passageway 72 is arranged to receive air from the first air passageway 70. The second air passageway 72 is located adjacent to the first air passageway 70, and extends upwardly alongside the first air passageway 70 towards the nozzle 14. The second air passageway 72 comprises an air inlet 102 located at the lower end of the rear section 78 of the casing section. The air inlet 102 is located opposite the air flow inlet 74 of the body 12. A second user-operable system is provided for generating a second air flow through the second air passageway 72. This second user-operable system comprises a second impeller 104 and a second motor 106 for driving the second impeller 104. In this embodiment, the second impeller 104 is in the form of a radial flow impeller, and the second motor 106 is in the form of a DC motor. The second motor 106 has a fixed rotational speed, and may be activated by the same control circuit used to activate the first motor 84. The second user-operable system is preferably configured to generate a second air flow which has an air flow rate which is lower than the minimum air flow rate of the first air flow. For example, the flow rate of the second air flow is preferably in the range from 1 to 5 liters per second, whereas the minimum flow rate of the first air flow is preferably in the range from 10 to 20 liters per second.

The second impeller 104 and the second motor 106 are mounted on a lower internal wall 108 of the body 12. As illustrated in FIG. 4, the second impeller 104 and the second motor 106 may be located upstream from the air inlet 102, and so arranged to direct the second air flow through the air inlet 102 and into the second air passageway 72. However, the second impeller 104 and the second motor 106 may be located within the second air passageway 72. The air inlet 102 may be arranged to receive the second air flow directly from the air flow inlet 74 of the body 12; for example the air inlet 102 may abut the internal surface of the air flow inlet 74.

The body 12 of the fan assembly 10 comprises a central duct 110 for receiving the second air flow from the air inlet 102, and for conveying the second air flow to the second air inlet 54 of the nozzle 14. In this embodiment, the second user-operable system comprises a humidifying system for increasing the humidity of the second air flow before it enters the nozzle 14, and which is housed within the body 12 of the fan assembly 10. This embodiment of the fan assembly may thus be considered to provide a humidifying apparatus. The humidifying system comprises a water tank 112 removably mountable on the lower wall 108. As illustrated in FIGS. 1 to 3, the water tank 112 has an outer convex wall 114 which provides part of the outer cylindrical surface of the body 12, and an inner concave wall 116 which extends about the duct 110. The water tank 112 preferably has a capacity in the range from 2 to 4 liters. The upper surface of the water tank 112 is shaped to define a handle 118 to enable a user to lift the water tank 112 from the lower wall 108 using one hand.

The water tank 112 has a lower surface to which a spout 120 is removably connected, for example through co-operating threaded connections. In this example the water tank 112 is filled by removing the water tank 112 from the lower wall 108 and inverting the water tank 112 so that the spout 120 is projecting upwardly. The spout 120 is then unscrewed from the water tank 112 and water is introduced into the water tank 112 through an aperture exposed when the spout 120 is disconnected from the water tank 112. Once the water tank 112 has been filled, the user reconnects the spout 120 to the water tank 112, re-inverts the water tank 112 and replaces the water tank 112 on the lower wall 108. A spring-loaded valve 122 is located within the spout 120 for preventing leakage of water through a water outlet 124 of the spout 120 when the water tank 112 is re-inverted. The valve 122 is biased towards a position in which a skirt 126 of the valve 122 engages the upper surface of the spout 120 to prevent water entering the spout 120 from the water tank 112.

The lower wall 108 comprises a recessed portion 130 which defines a water reservoir 132 for receiving water from the water tank 104. A pin 134 extending upwardly from the recessed portion 130 of the lower wall 108 protrudes into the spout 120 when the water tank 112 is located on the lower wall 108. The pin 134 pushes the valve 122 upwardly to open the spout 120, thereby allowing water to pass under gravity into the water reservoir 132 from the water tank 112. This results in the water reservoir 132 becoming filled with water to a level which is substantially co-planar with the upper surface of the pin 134. A magnetic level sensor 135 is located within the water reservoir 132 for detecting the level of water within the water reservoir 132.

The recessed portion 130 of the lower wall 108 comprises an aperture 136 each for exposing the surface of a respective piezoelectric transducer 138 located beneath the lower wall 108 for atomising water stored in the water reservoir 132. An annular metallic heat sink 140 is located between the lower wall 128 and the transducer 138 for transferring heat from the transducer 138 to a second heat sink 142. The second heat sink 142 is located adjacent a second set of apertures 144 formed in the outer surface of the casing section of the body 12 so that heat can be conveyed from the second heat sink 142 through the apertures 144. An annular sealing member 146 forms a water-tight seal between the transducer 138 and the heat sink 140. A drive circuit is located beneath the lower wall 128 for actuating ultrasonic vibration of the transducer 138 to atomize water within the water reservoir 132.

An inlet duct 148 is located to one side of the water reservoir 132. The inlet duct 148 is arranged to convey the second air flow into the second air passageway 72 at a level which is above the maximum level for water stored in the water reservoir 132 so that the air flow emitted from the inlet duct 148 passes over the surface of the water located in the water reservoir 132 before entering the duct 112 of the water tank 102.

Figure 8:
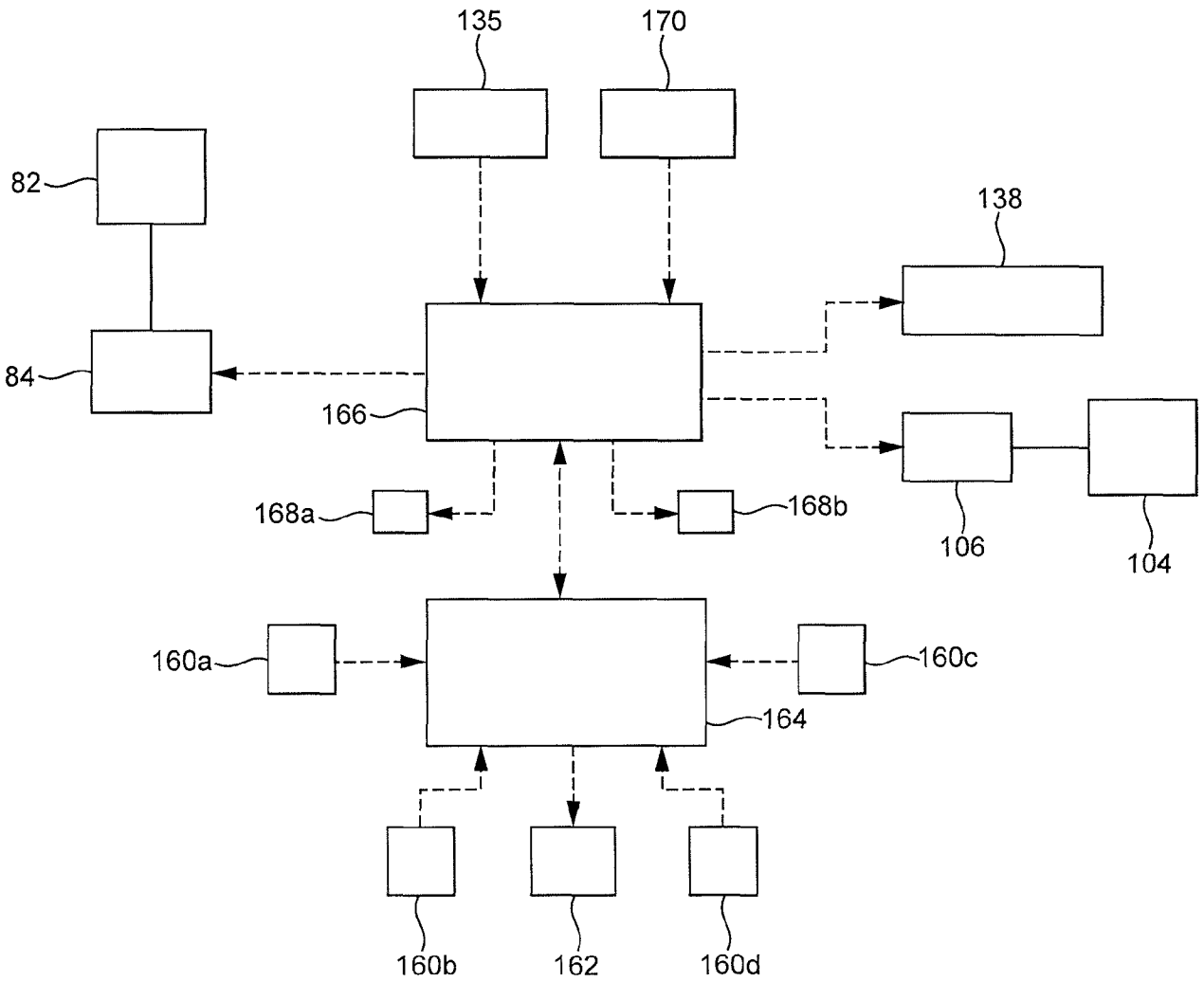
FIG. 8 is a schematic illustration of a control system of the fan assembly.

A user interface for controlling the operation of the fan assembly is located on the side wall of the casing section of the body 12. FIG. 8 illustrates schematically a control system for the fan assembly 10, which includes this user interface and other electrical components of the fan assembly 10. In this example, the user interface comprises a plurality of user-operable buttons 160*a*, 160*b*, 160*c*, 160*d* and a display 162. The first button 160*a* is used to activate and deactivate the first motor 84, and the second button 160*b* is used to set the speed of the first motor 84, and thus the rotational speed of the first impeller 82. The third button 160*c* is used to activate and deactivate the second motor 106. The fourth button 160*d* is used to set a desired level for the relative humidity of the environment in which the fan assembly 10 is located, such as a room, office or other domestic environment. For example, the desired relative humidity level may be selected within a range from 30 to 80% at 20° C. through repeated pressing of the fourth button 160*d*. A display 162 provides an indication of the currently selected relative humidity level.

The user interface further comprises a user interface circuit 164 which outputs control signals to a drive circuit 166 upon depression of one of the buttons, and which receives control signals output by the drive circuit 166. The user interface may also comprise one or more LEDs for providing a visual alert depending on a status of the humidifying apparatus. For example, a first LED 168*a* may be illuminated by the drive circuit 166 indicating that the water tank 112 has become depleted, as indicated by a signal received by the drive circuit 166 from the level sensor 135.

A humidity sensor 170 is also provided for detecting the relative humidity of air in the external environment, and for supplying a signal indicative of the detected relative humidity to the drive circuit 166. In this example the humidity sensor 170 may be located immediately behind the air flow inlet 74 to detect the relative humidity of the air flow drawn into the fan assembly 10. The user interface may comprise a second LED 168*b* which is illuminated by the drive circuit 166 when an output from the humidity sensor 170 indicates that the relative humidity of the air flow entering the fan assembly 10 is at or above the desired relative humidity level set by the user.

To operate the fan assembly 10, the user depresses the first button 160*a*, in response to which the drive circuit 166 activates the first motor 84 to rotate the first impeller 82. The rotation of the first impeller 82 causes air to be drawn into the body 12 through the air flow inlet 74. An air flow passes through the first air passageway 70 to the first air inlet 28 of the nozzle 14, and enters the first interior passage 46 within the rear section 16 of the nozzle 14. At the base of the first interior passage 46, the air flow is divided into two air streams which pass in opposite directions around the bore 20 of the nozzle 14. As the air streams pass through the first interior passage 46, air enters the mouth 48 of the nozzle 14. The air flow into the mouth 48 is preferably substantially even about the bore 20 of the nozzle 14. The mouth 48 guides the air flow towards the first air outlet 30 of the nozzle 14, from where it is emitted from the fan assembly 10.

The air flow emitted from the first air outlet 30 is directed over the Coanda surface 40 of the nozzle 14, causing a secondary air flow to be generated by the entrainment of air from the external environment, specifically from the region around the first air outlet 30 and from around the rear of the nozzle 14. This secondary air flow passes through the bore 20 of the nozzle 14, where it combines with the air flow emitted from the nozzle 14.

When the first motor 84 is operating, the user may increase the humidity of the air flow emitted from the fan assembly 10 by depressing the third button 160*c*. In response to this, the drive circuit 166 activates the second motor 106 to rotate the second impeller 104. As a result, air is drawn from the first air passageway 70 by the rotating second impeller 104 to create a second air flow within the second air passageway 72. The air flow rate of the second air flow generated by the rotating second impeller 104 is lower than that generated by the rotating first impeller 82 so that a first air flow continues to pass through the first air passageway 70 to the first air inlet 28 of the nozzle 14.

Simultaneous with the actuation of the second motor 106, the drive circuit 166 actuates the vibration of the transducer 138, preferably at a frequency in the range from 1 to 2 MHz, to atomize water present within the water reservoir 132. This creates airborne water droplets above the water located within the water reservoir 132. As water within the water reservoir 132 is atomized, the water reservoir 132 is constantly replenished with water from the water tank 112, so that the level of water within the water reservoir 132 remains substantially constant while the level of water within the water tank 112 gradually falls.

With rotation of the second impeller 104, the second air flow passes through the inlet duct 148 and is emitted directly over the water located in the water reservoir 132, causing airborne water droplets to become entrained within the second air flow. The—now moist—second air flow passes upwardly through the central duct 110 second air passageway 72 to the second air inlet 54 of the nozzle 14, and enters the second interior passage 58 within the front section 18 of the nozzle 14. At the base of the second interior passage 58, the second air flow is divided into two air streams which pass in opposite directions around the bore 20 of the nozzle 14. As the air streams pass through the second interior passage 58, each air stream is emitted from a respective one of the second air outlets 56 located in the front end 44 of the nozzle 14. The emitted second air flow is conveyed away from the fan assembly 10 within the air flow generated through the emission of the first air flow from the nozzle 14, thereby enabling a humid air current to be experienced rapidly at a distance of several meters from the fan assembly 10.

Provided that the third button 160*c* has not been subsequently depressed, the moist air flow is emitted from the front section 18 of the nozzle until the relative humidity of the air flow entering the fan assembly, as detected by the humidity sensor 170, is 1% at 20° C. higher than the relative humidity level selected by the user using the fourth button 160*d*. The emission of the moistened air flow from the front section 18 of the nozzle 14 is then terminated by the drive circuit 166, through terminating the supply of actuating signals to the transducer 138. Optionally, the second motor 106 may also be stopped so that no second air flow is emitted from the front section 18 of the nozzle 14. However, when the humidity sensor 170 is located in close proximity to the second motor 106 it is preferred that the second motor 106 is operated continually to avoid undesirable temperature fluctuation in the local environment of the humidity sensor 170. When the humidity sensor 170 is located outside the fan assembly 10, for example, the second motor 106 may also be stopped when the relative humidity of the air of the environment local to the humidity sensor 170 is 1% at 20° C. higher than the relative humidity level selected by the user.

As a result of the termination of the emission of a moist air flow from the fan assembly 10, the relative humidity detected by the humidity sensor 170 will begin to fall. Once the relative humidity of the air of the environment local to the humidity sensor 170 has fallen to 1% at 20° C. below the relative humidity level selected by the user, the drive circuit 166 outputs actuating signals to the transducer 138 to re-start the emission of a moist air flow from the front section 18 of the nozzle 14. As before, the moist air flow is emitted from the front section 18 of the nozzle 14 until the relative humidity detected by the humidity sensor 170 is 1% at 20° C. higher than the relative humidity level selected by the user, at which point the actuation of the transducer 138 is terminated.

This actuation sequence of the transducer 138 for maintaining the detected humidity level around the level selected by the user continues until one of the buttons 160*a*, 160*c* is depressed or until a signal is received from the level sensor 135 indicating that the level of water within the water reservoir 132 has fallen by the minimum level. If the button 160*a* is depressed, the drive circuit 166 deactivates both motors 84, 106 to switch off the fan assembly 10.

The invention claimed is:

1. A fan assembly comprising:

a nozzle having a plurality of air inlets, a plurality of air outlets, a first air flow path entirely within the nozzle and a second air flow path entirely within the nozzle, each air flow path extending from at least one of the air inlets to at least one of the air outlets, the nozzle defining a bore through which air from outside the fan assembly is drawn by air emitted from the nozzle, wherein the nozzle is mounted on a body housing a first and a second user-operable system and each air flow path extends at least partially about the bore of the nozzle;

the first user-operable system comprising a first impeller and a first motor for driving the first impeller that generates a first air flow along the first air flow path; and the second user-operable system comprising a second impeller and a second motor for driving the second impeller, different from the first user-operable system, that generates a second air flow within the body that travels along the second air flow path.

2. The fan assembly of claim 1, wherein each user-operable system is located upstream from its respective air flow path.

3. The fan assembly of claim 1, comprising a first air passageway for conveying the first air flow to the first air flow path and a second air passageway for conveying the second air flow to the second air flow path.

4. The fan assembly of claim 3, comprising an air flow inlet for admitting at least the first air flow into the fan assembly.

5. The fan assembly of claim 4, wherein the air flow inlet comprises a plurality of apertures.

6. The fan assembly of claim 3, wherein the second air passageway is arranged to receive air from the first air passageway.

7. The fan assembly of claim 6, wherein the second air passageway is arranged to receive the air from the first air passageway upstream from the first user-operable system.

8. The fan assembly of claim 1, wherein the body comprises a first air passageway for conveying the first air flow to the first air flow path and a second air passageway for conveying the second air flow to the second air flow path.

9. The fan assembly of claim 8, wherein the first and second air passageways extend vertically through the body.

10. The fan assembly of claim 8 or claim 9, wherein the first air passageway is located adjacent the second air passageway.

11. The fan assembly of claim 1, wherein the impeller of the first user-operable system is different from the impeller of the second user-operable system.

12. The fan assembly of claim 1, wherein the motor of the first user-operable system is different from the motor of the second user-operable system.

13. The fan assembly of claim 1, wherein said at least one air outlet of the first air flow path is located behind said at least one air outlet of the second air flow path.

14. The fan assembly of claim 1, wherein the first air flow path and the second air flow path each extend fully about the bore of the nozzle.

15. The fan assembly of claim 1, wherein the first air flow path is separate from the second air flow path.

16. The fan assembly of claim 1, wherein said at least one air outlet of the first air flow path comprises an air outlet which extends about the bore of the nozzle.

17. The fan assembly of claim 16, wherein the air outlet of the first air flow path is continuous.

18. The fan assembly of claim 1, wherein said at least one air outlet of the first air flow path is arranged to emit the first air flow through at least a front part of the bore.

19. The fan assembly of claim 18, wherein said at least one air outlet of the first air flow path is arranged to emit the first air flow over a surface defining said front part of the bore.

20. The fan assembly of claim 1, wherein said at least one air outlet of the second air flow path is located in a front end of the nozzle.

21. The fan assembly of claim 20, wherein said at least one air outlet of the second air flow path comprises a plurality of air outlets located about the bore.

22. The fan assembly of claim 21, wherein each of the plurality of air outlets of the second air flow path comprises one or more apertures.

23. The fan assembly of claim 1, wherein the second user-operable system is arranged to change a sensorial property of the second air flow before it is emitted from the nozzle.

24. The fan assembly of claim 1, wherein the second user-operable system is configured to change one of the temperature, humidity, composition and electrical charge of the second air flow before it is emitted from the nozzle.

* * * * *